United States Patent [19]

Olofsson

[11] 4,038,961

[45] Aug. 2, 1977

[54] PNEUMATIC RIFLE AND HAND GUN

[75] Inventor: Sigfrid M. Olofsson, Munkedal, Sweden

[73] Assignee: Dahltron Corporation, Lombard, Ill.

[21] Appl. No.: 606,972

[22] Filed: Aug. 22, 1975

[51] Int. Cl.[2] ..... F41B 11/00; F41F 1/04

[52] U.S. Cl. ..... 124/69; 124/68; 124/76; 417/258

[58] Field of Search ..... 124/68, 69, 70, 71, 124/73, 74, 75, 76, 63, 64, 65, 66; 417/258

[56] References Cited

U.S. PATENT DOCUMENTS

| | | | |
|---|---|---|---|
| 558,841 | 4/1896 | Raymond | 124/69 |
| 1,266,876 | 5/1918 | Spear et al. | 417/258 |
| 1,299,901 | 4/1919 | Blair | 124/76 |
| 2,924,211 | 2/1960 | McSwain | 124/74 X |
| 2,938,513 | 5/1960 | Giss | 124/68 |
| 3,233,602 | 2/1966 | Partanen | 124/68 X |
| 3,308,803 | 3/1967 | Walther | 124/69 |

*Primary Examiner*—Richard T. Stouffer
*Attorney, Agent, or Firm*—Edward D. Gilhooly

[57] ABSTRACT

A pneumatic rifle and hand gun for discharging a projectile under the influence of a source of compressed gas such as air. The pressurization of the source is achieved by with pressure increasing mechanisms which compress atmospheric air in two separate stages using a single cocking or pumping action of the rifle or hand gun. The rifle and hand gun are provided with a recoil compensation device to eliminate recoil of the rifle and hand gun during discharge of the projectile. The compression of the atmospheric air to provide the source of high pressure is achieved through a novel piston and cylinder arrangement which pressurizes the gas during pumping or cocking action of the rifle or hand gun. A further mechanism provides for a projectile discharged from the rifle or hand gun to be subjected to constant pressure during discharge thereof.

15 Claims, 17 Drawing Figures

Fig. 1
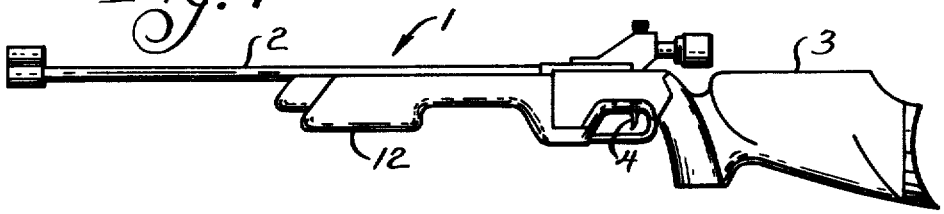
Fig. 2
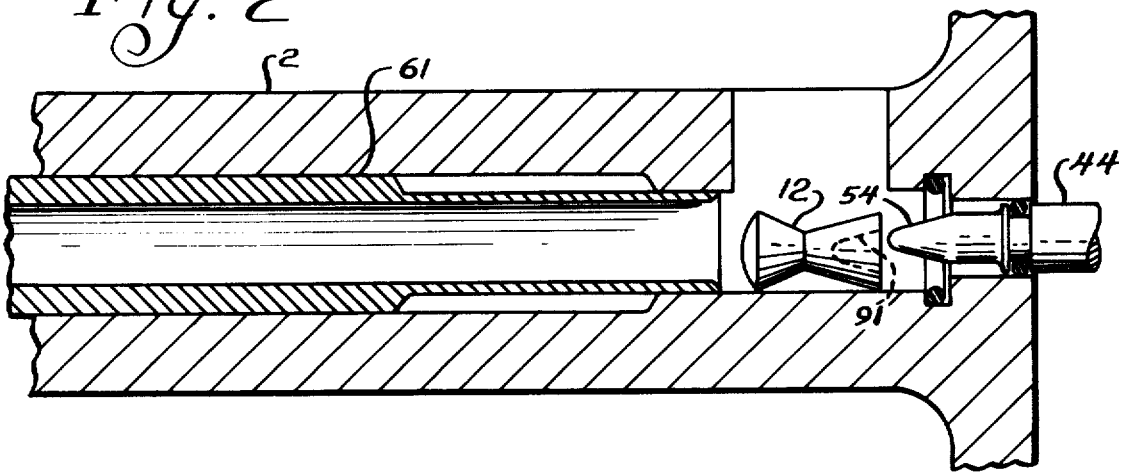
Fig. 3
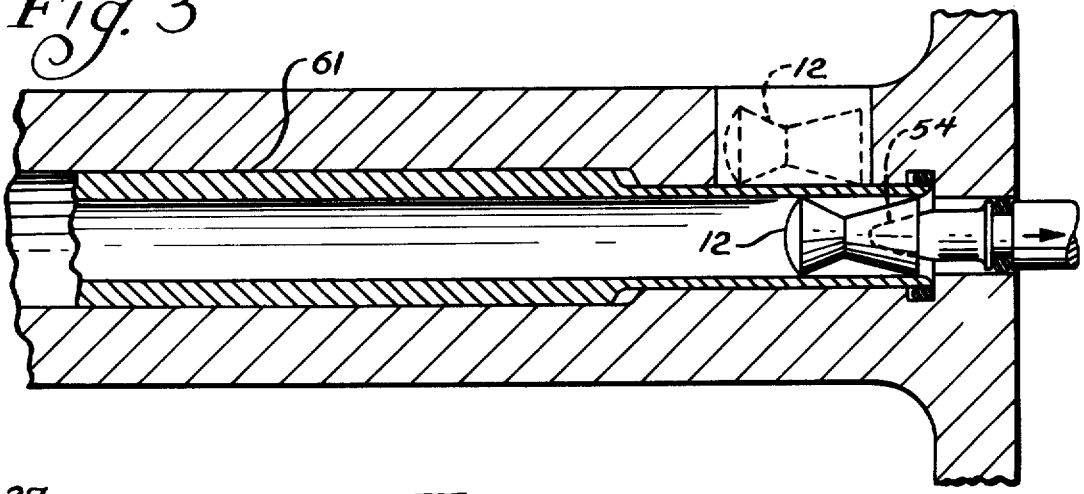
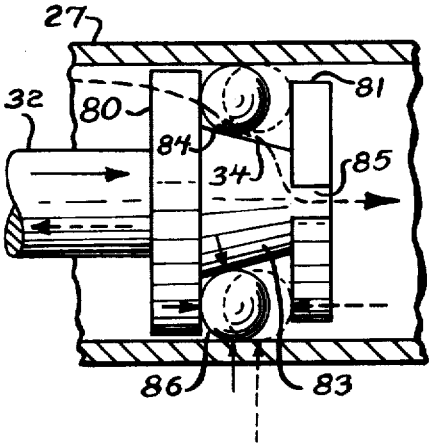
Fig. 4
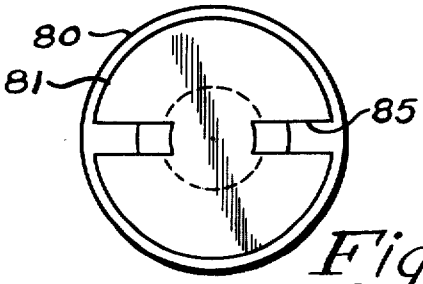
Fig. 5

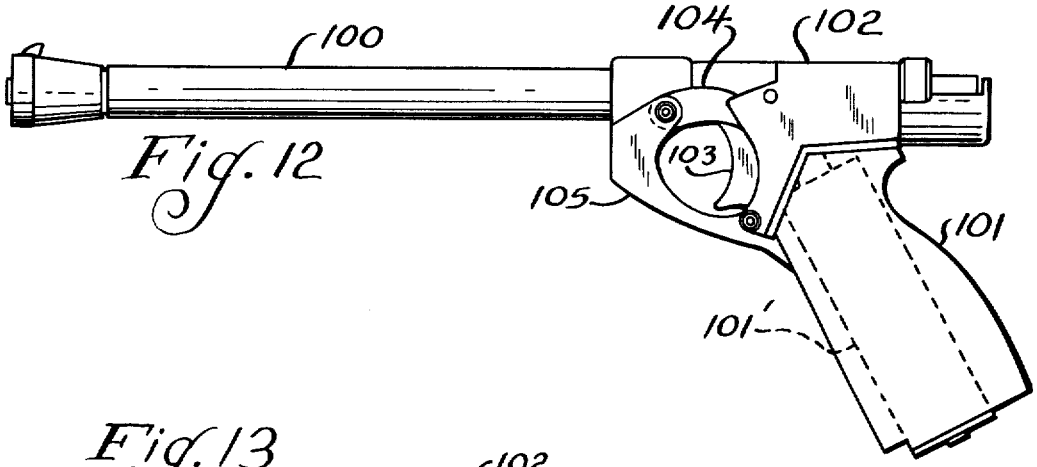
Fig. 12
Fig. 13
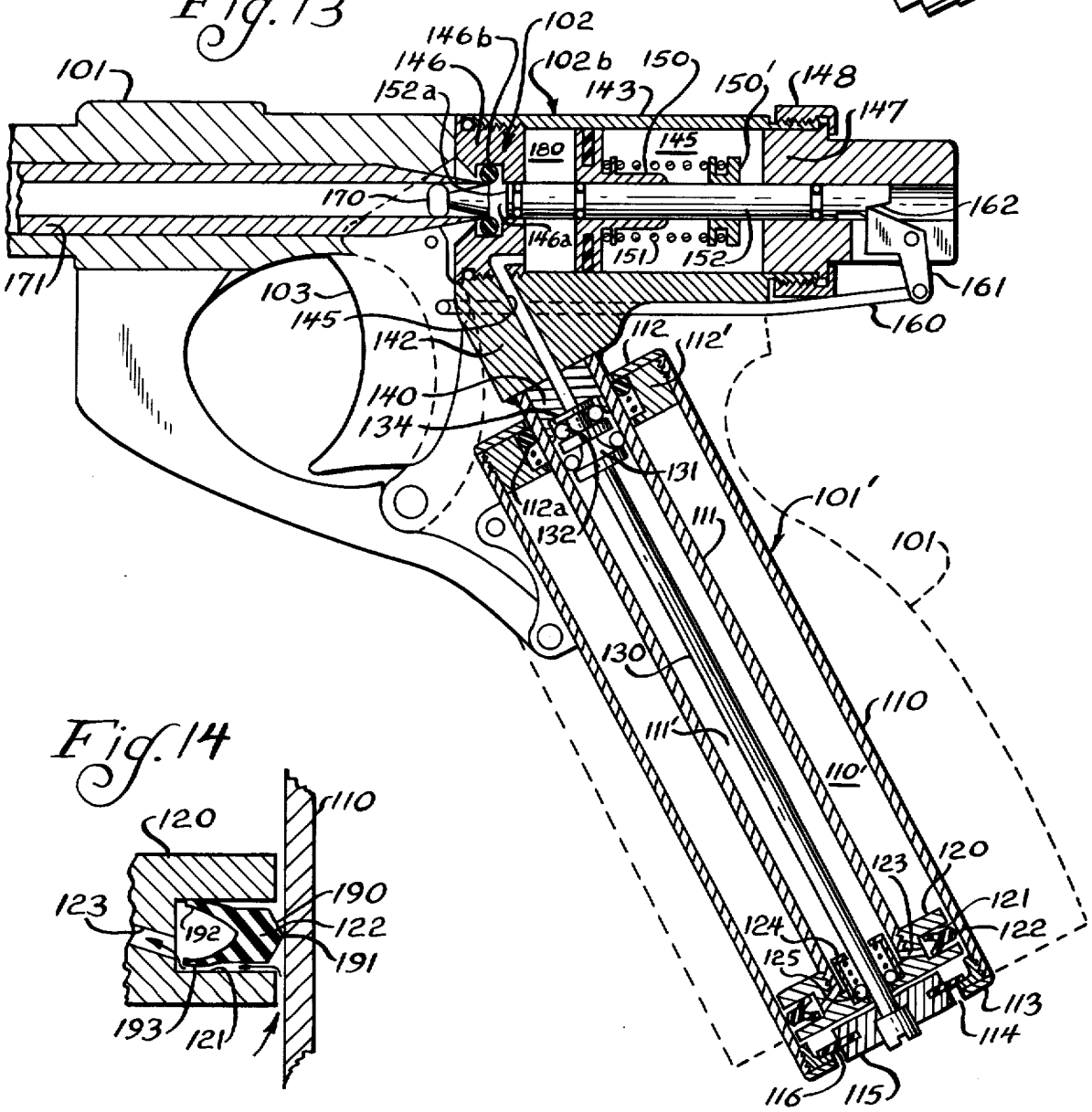
Fig. 14

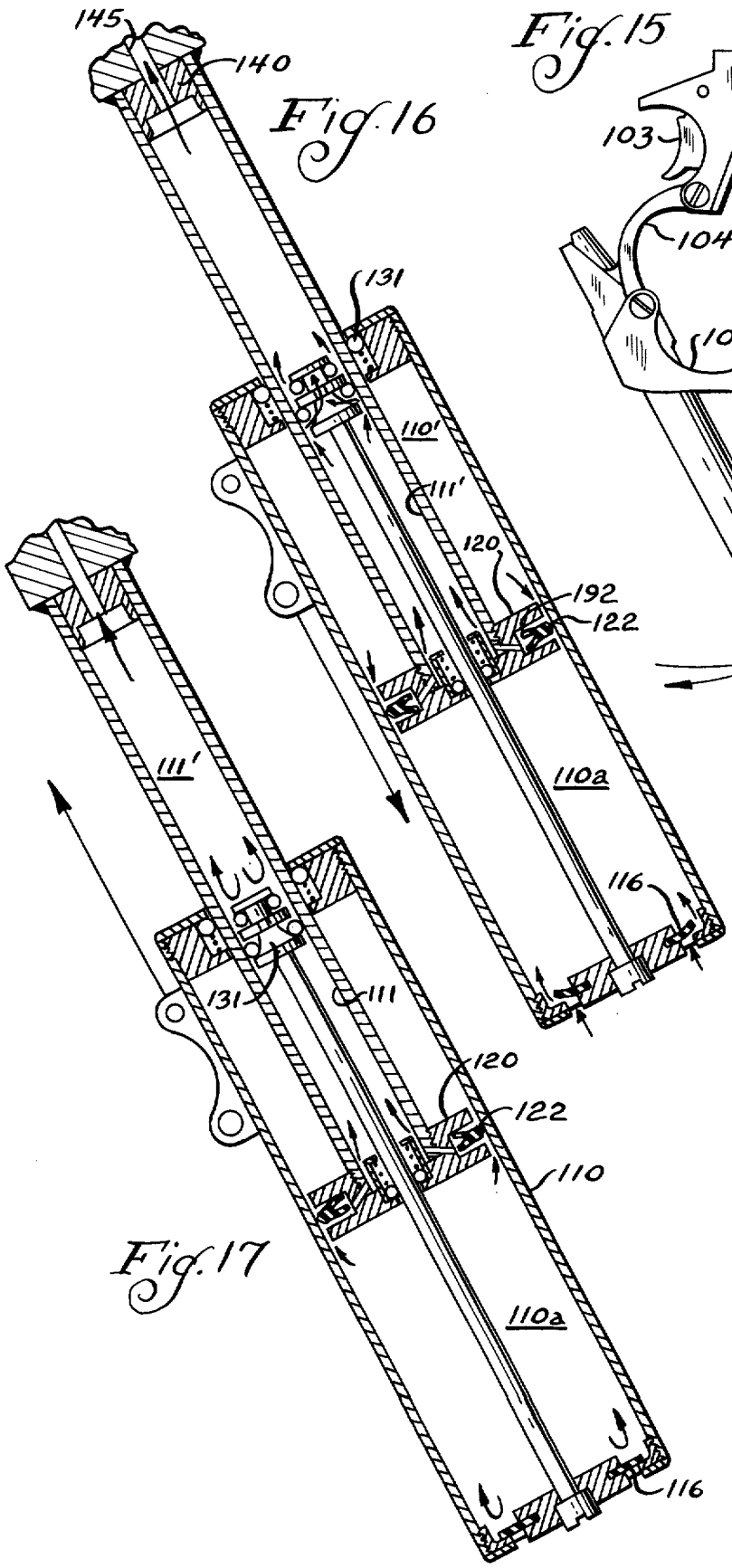
Fig. 16
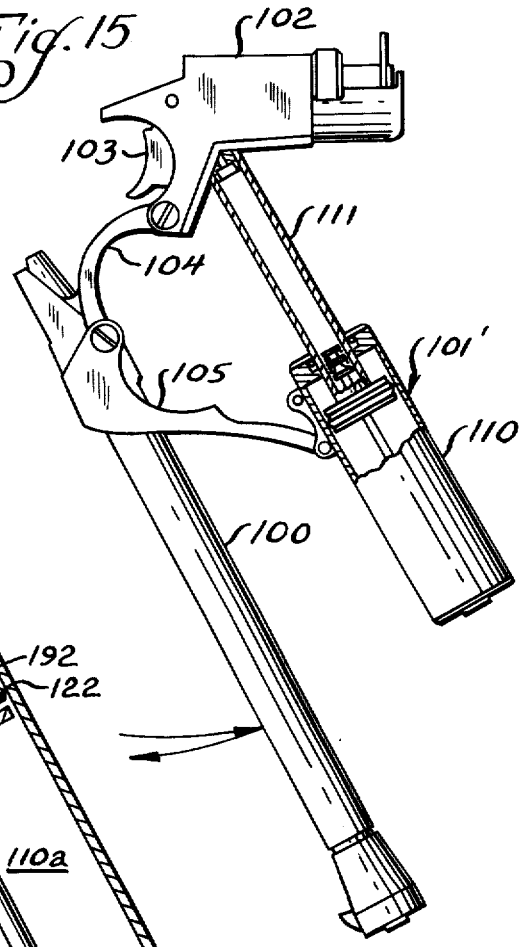
Fig. 15
Fig. 17

PNEUMATIC RIFLE AND HAND GUN

BACKGROUND OF THE INVENTION

This invention relates in general to devices for discharging projectiles and in particular, to a pneumatic rifle and hand gun.

More specifically, the invention relates to a pneumatic rifle or hand gun in which a projectile is discharged under the infuence of a source of high pressure. The source is pressurized by a single pumping or cocking stroke which subjects atmospheric air to a plurality of pressurizing stages. The device of the invention further includes an anti-recoil mechanism that effectively compensates and eliminates recoil of the rifle or hand gun during discharge of the projectile. The rifle or hand gun embodying the teachings of the invention is a highly accurate device which can discharge projectiles at high velocity.

In the prior art it is well known to utilize a pneumatic rifle or hand gun to discharge projectiles for recreation and other purposes such as in target shooting, hunting and many other areas of use. Despite the widespread use of pneumatic guns in the past, numerous problems have been associated with the use of the prior art type devices. Many older versions are inaccurate devices which subject a projectile to pressures which are not sufficient to discharge it at a relatively high velocity or which pressure source is inaccurately and inconsistently pressurized over extended operations. Certain pneumatic guns have been developed which can subject a projectile to a high pressure but suffer from being complex in design and very inconvenient in use. One particular type of gun known in the prior art requires that the pressure source, to which the projectile is subjected for discharge, be "pumped up" by a cocking action often reaching 12 repetitions. Obviously, during recreational use or other activities, the necessity of pumping a gun numerous times before discharge interferes drastically with the effectiveness of the device. Still another problem associated with prior art pneumatic devices lies in the fact that the pressure is subject to leakage to cause the initial level of pressure to which the source is charged to dissipate after short durations of time, whereby the gun loses its accuracy and effectiveness.

SUMMARY OF THE INVENTION

It is, therefore, an object of this invention to improve the effectiveness and accuracy of pneumatic hand guns and rifles.

A further object of this invention is to subject a projectile to a source of pressure which is fully charged through the action of one cocking or pumping repetition.

Another object of this invention is to subject pneumatic air to a plurality of compression stages to charge a pressure source in a pneumatic hand gun or rifle.

A still further object of this invention is to eliminate recoil during the discharge of a projectile from a pneumatic device.

Still another object of this invention is to increase the accuracy of a pneumatic hand gun or rifle.

These and other objects are attained in accordance with the present invention wherein there is provided an improved device for discharging a projectile after being exposed to a source of high fluid pressure. The source of pressure within the device is charged through the cocking or pumping of an improved pressure increasing mechanism. The pressure source is pressurized by subjecting atmospheric air to a plurality of pressure increasing stages. This pressurization is attained through one single manual pumping or cocking repetition eliminating the necessity of numerous repetitions as required in many pneumatic guns hereinbefore provided in the prior art.

The pressurizing mechanism of the invention includes a number of operatively connected chambers having movable piston-like elements therein to charge the source to a predetermined level by a single easily manipulated movement of a portion of the hand gun or rifle. The device also includes an anti-recoil feature to eliminate recoil action caused by the discharge of the projectile during use of the gun whereby the accuracy and aim of the device is not handicapped as in prior art guns. Not only does the device of the invention significantly improve the accuracy and effectiveness of pneumatic guns, but accomplishes such improved results with a device which is relatively simpler in design and more durable in use.

BRIEF DESCRIPTION OF THE DRAWINGS

Further objects of the invention together with additional features contributing thereto and advantages accruing therefrom will be apparent from the following description of several embodiments of the invention when read in conjunction with the accompanying drawings wherein:

FIG. 1 is a schematic illustration of one embodiment of the pneumatic rifle of the present invention;

FIG. 2 is an enlarged sectional illustration of the projectile chamber and barrel of the rifle of FIG. 1 during pumping of the rifle;

FIG. 3 is an enlarged sectional illustration of the projectile chamber and barrel of the rifle of FIG. 1 before discharge of a projectile;

FIG. 4 is an enlarged schematic illustration of the double-acting piston and seal utilized in the pressurizing mechanism of the rifle of FIG. 1;

FIG. 5 is a front schematic illustration of the double-acting piston and seal of FIG. 4;

FIG. 12 is a side schematic illustration of another embodiment of the invention for a pneumatic hand gun;

FIG. 13 is a partial schematic illustration with parts broken away of the hand gun of FIG. 12 with the pressure source attaining maximum pressure after cocking action prior to discharge of a projectile;

FIG. 14 is an enlarged partial sectional illustration of the piston utilized in the pressurizing system of the pistol of FIG. 12;

FIG. 15 is a schematic illustration of the hand gun of FIG. 12 in a cocked position to energize the pressure source;

FIG. 16 is a sectional illustration of the pressurization mechanism of the pistol in FIG. 12 during cocking of the pistol in a first opening direction; and FIG. 17 is a sectional illustration of the pressurizing system of the hand gun of FIG. 12 during cocking action in a closing direction to finalize pressurization of the source.

DESCRIPTION OF THE PREFERRED EMBODIMENT

Figures 6, 7:
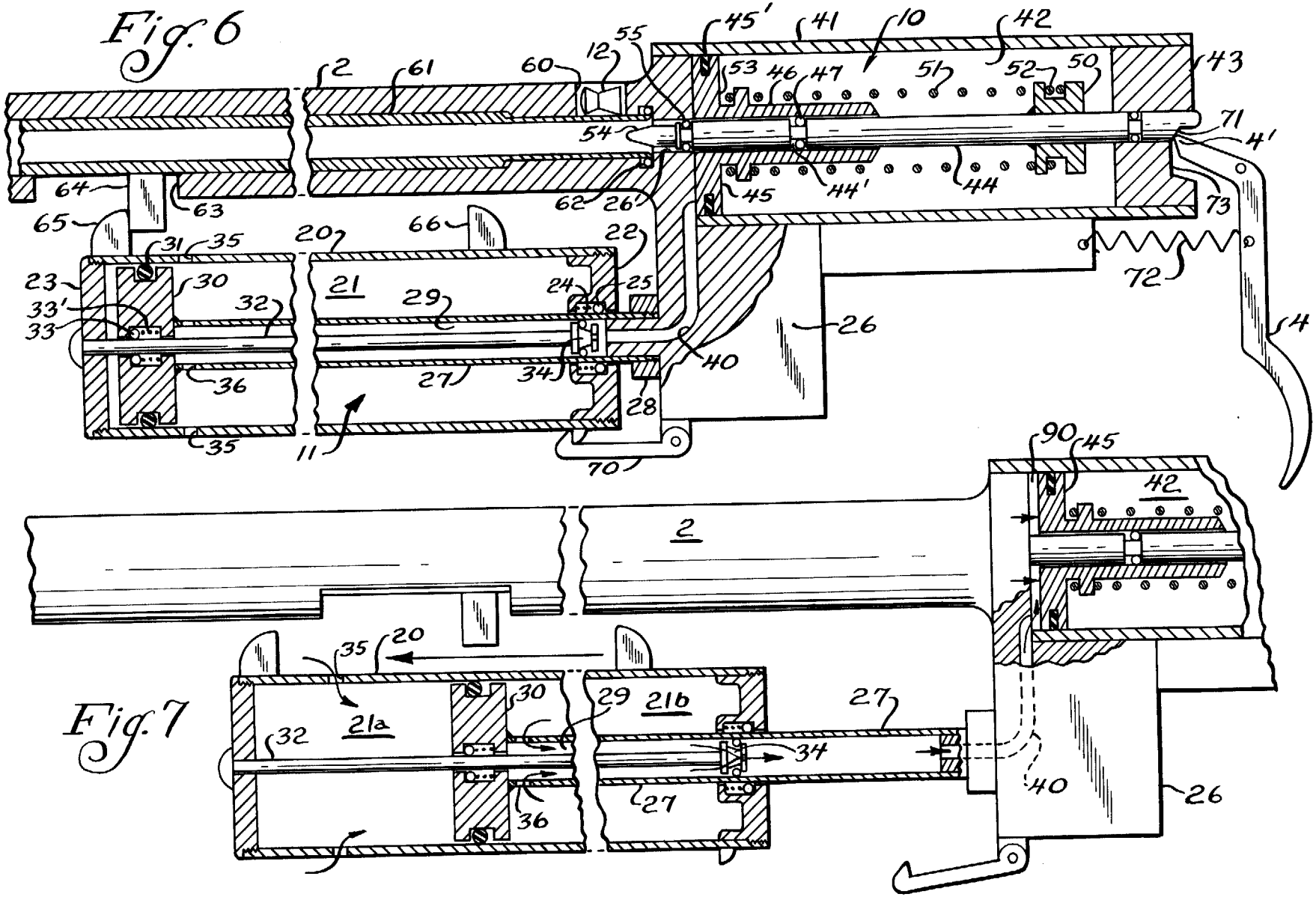
FIG. 6 is a sectional illustration of the pressurizing system adjacent the barrel of the rifle of FIG. 1 prior to charging the pressure source for discharge of a projectile.
FIG. 7 is a schematic side illustration with parts broken away of the pressurizing system of the rifle of FIG. 1 during the outward motion of the pressurizer system of the pumping actuator.

Referring to FIG. 1, there is illustrated a schematic side illustration of a design of a pneumatic rifle embodying the teachings of the invention. Pneumatic rifle 1 of FIG. 1 includes standard elements of rifles including barrel 2 for discharging a projectile, a stock 3 and a triggered mechanism 4. By actuating trigger 4, a projectile is discharged from rifle 1 under the influence of a pneumatic source of pressure in a manner to be described in detail later.

Referring now to FIG. 6 there is shown the pressurizing system of the rifle 1 mounted adjacent barrel 2. The pressurizing system includes a pressure source 10 to selectively apply pressure to projectile 12 after being actuated and a pressure actuator 11 mounted beneath the barrel to increase the pressure of source 10 in a manner that the projectile can be effectively hurled or discharged. The operation of the pressurization of source 10 by actuator 11 will be apparent from later description herein. The pressure source 10 and actuator 11 are mounted in the body of rifle 1 at a position in front of trigger 4. Although source 10 and actuator 11 are illustrated as being so located, it is within the scope of the invention to place these mechanisms at other locations within a rifle if convenient and desired.

Referring now to the details of pressure actuator 11 mounted beneath barrel 2 in FIG. 6, there is shown a cylinder 20 forming an outer chamber 21. Cylinder 20 is suitably closed at one end by an end wall 22 and at the other opposite end by end wall 23. A passage 24 is provided through end wall 22 wherein the end wall includes a suitable combined bearing and sealing mechanism 25. Cylinder 20 is supported on an integral portion 26 of barrel 2 forming a portion of a body portion of the rifle by means of an inner cylinder 27 which passes through passage 24 of end wall 22.

Inner cylinder 27 can be suitably attached to body portion 26 of the rifle by any convenient securing means such as by nut element 28. Cylinder 27 extends through outer chamber 21 in the position shown in FIG. 6 and forms an inner chamber 29 and further includes a piston 30 affixed to one end of the cylinder 27. Piston 30 possesses an outer periphery which contacts the interior wall of outer cylinder 20 in sealing relationship through the use of a conventional O ring or the like 31.

A longitudinal rod 32 extends in inner chamber 29 through an opening 33 in the center of piston 30 with bearing and seal 33 and the rod is attached at one end on end wall 23. The other end of rod 32 is provided with a double-acting seal and piston 34 to be described in detail later. In the position of the actuator illustrated in FIG. 6 showing the rifle prior to pressurization of source 10, one or more openings 35 are positioned through outer cylinder 21 in communication with atmosphere at location immediately adjacent piston 30. In addition, one or more openings 36 are provided adjacent piston 30 to permit fluid communication between outer chamber 21 and inner chamber 29 in the position of the actuator shown in FIG. 6. From the foregoing description, it should be apparent to one skilled in the art that cylinder 20 is capable of relative movement to inner cylinder 27 and piston 30.

Pressure actuator 11 is in fluid communication with pressure source 10 through a conduit 40 provided in body portion 26 of the rifle and extends between inner chamber 29 and to cylinder 41 forming pressure source chamber 42. Cylinder 41 is suitably attached in sealing relationship to body portion 26 of the rifle at one end and includes a plug 43 at the other. A rod 44 is longitudinally disposed in chamber 42 passing through plug 43 and into body portion 26 of rifle through a passage 26'. In FIG. 6 it is shown that rod 44 supports a piston 45 for relative movement wherein piston 45 has an outer periphery carrying a seal 45' in sealing contact with cylinder 41. Piston includes an integral hub 46 extending along rod 44 with suitable notch 44' positioned on the rod to carry sealing element 47 that permits relative movement between the piston and hub and rod 44.

Rod 44 further carries a collar 50 which is affixed to the rod by means of welding or any other suitable technique and lies in spaced relationship to piston 45 and hub 46. The movement of piston 45 and hub 46 is operatively connected with collar 50 by means of a suitable spring 51 respectively attached to a slot 52 in collar 50 and a slot 53 in hub portion 46 of the piston. The cooperation of the collar 50 and piston 45 will be apparent in the following description. Rod 44 projects into barrel 2 through a passage 26' formed in the body portion of the rifle and possesses a conical end 54 therein. The diameter of conical projection 54 is less than the diameter of passage 26' and is sealed by means of a conventional O-ring 55.

Barrel 2 carries a slot 60 at the upper portion of thereof in general vicinity of conical projection 54 whereby any suitable mechanism for supporting a projectile 12 can be utilized whereby a single projectile is introduced into the barrel 2. However, prior to actuation of the pressure source 10, introduction of a projectile is prevented because of the presence of an inner barrel 61 mounted for relative movement within outer barrel 2. Inner barrel 61 includes a seal 62 to seal the end of the inner barrel during pressurization. In addition, barrel 2 includes a lower slot 63 whereby a projection 64 passes therethrough in integral connection to inner barrel 61 to operatively contact stops 65 and 66 mounted in predetermined position on outer cylinder 20 of pressure actuator 11 during charging of the pressure source.

Movement of outer cylinder 20 relative to cylinder 27 of pressure actuator can for safety reasons be arrested by means of a suitable locking mechanism 70 interconnecting body portion 26 and a suitable notch on cylinder 20. The release of locking mechanism 70 then would permit a user of the rifle to manually move cylinder 20 relative to inner cylinder 27 in the manner described later.

Still referring to FIG. 6 it will be seen that the rear end of rod 44 of pressure source 10 passes through end plug 43 and includes a slanted surface 72. Trigger 4 is biased by spring 21 and end 4 of the trigger is moved into area 73 formed in plug 43 when pulled and thus out of interference with rod 44.

In the foregoing description, the elements of the pressure actuator 11 and the pressure source 10 along with barrel 2 have been described in detail. The following description with reference to FIGS. 2 through 11 will clearly describe the functional cooperation of the elements in order to discharge a projectile in accordance with the invention. It should be pointed out that the outer cylinder 20 is located within handle 12 of rifle 1 shown in FIG. 1 whereby as an operator pushes it toward the end of the barrel and back in a pumping action and the pressurization of source 10 is achieved. In other words, the elements shown in the actuator and pressure source are contained within the body of the rifle within handle 12 and in front of trigger 4 in the embodiment shown in FIG. 1. Thus, handle 12 is mounted by means (not shown) for manual reciprocation relative to barrel 2 to actuate the rifle.

Prior to actuation of the pressure source in order to carry out a discharge of a projectile, it is necessary that slot 60 attached to any type of projectile storage mechanism have at least one projectile 12 at the position shown in FIG. 6. It is within the scope of the invention that the projectile storage mechanism retains a plurality of projectiles, but one element would be in the position shown.

The operation of the device for actuation is illustrated in FIG. 7 as the handle 12 is pumped forward in approximately its mid-portion of its stroke. It should be understood that prior to movement outer chamber 20 and inner chamber 29 are at atmospheric pressure because of the position openings 35 and 36 as shown in FIG. 6. Moreover, the design of the rifle requires that chamber 42 of pressure source 10 be pressurized at a pressure greater than atmosphere and is pressurized during operation of the gun in a manner to be described later. Since chamber 42 is adequately sealed as previously described, a pressure greater than atmosphere is maintained at all times within chamber 42.

To actuate the pressure source for the purpose of discharging a projectile, the operator grasps the handle 12 to move cylinder 20 relative to piston 30 and inner cylinder 27 of the actuator. During its initial movement toward the end of the barrel in the outward stroke as shown in FIG. 7 it should be apparent that piston 30 passes opening 35 whereby outer chamber 21 becomes sealed with respect to atmosphere. After piston 30 passes opening 35 atmospheric air is thereafter being introduced into the left side of the piston into chamber 21*a*. On the right side of the piston 30 chamber 21*b* becomes sealed with only fluid comunication being possible through openings 36 into inner chamber 29.

At this position of the outer cylinder relative to the piston and inner cylinder, as in FIG. 7, double-acting piston and seal 34 acts to permit the pressure being compressed by piston 30 during relative movement of cylinder 20 to pass through inner cylinder 27 into passage 40 in the rifle. The structure and function of double-acting seal and piston 34 is best shown in FIGS. 4 and 5. Piston and seal 34 includes a disc 80 attached to the end of rod 32 and has a peripheral surface providing a fluid passage between its periphery and inner cylinder 27. Piston 34 further includes a second spaced disc 81 mounted on the opposite side from rod 32 and has a diameter somewhat smaller than disc 80 whereby disc 80 and disc 81 are innerconnected by a body 83 having an outer surface in the form of a truncated cone 84. The diameter of body 84 is larger adjacent disc 84 than adjacent disc 81. A pair of oppositely disposed slots 85 are provided through disc 81 to form a flow passage therebetween.

A suitable O-ring functions to either seal the flow past element 34 so that the element can function as a piston or the O-ring can move to a second position whereby the flow can pass the element. In the position shown in FIG. 4 the O-ring is situated adjacent disc 80 and prevents flow therepast because the inner periphery of the O-ring is in sealing contact with surface 84 and the outer periphery contacts cylinder 27. As shown in phantom in FIG. 4, the O-ring can move to a second position to contact disc 83 whereby the inner diameter of the O-ring is greater than the diameter of the truncated surface 84 and flow can pass the periphery of disc 80 between the O-ring and body 83 and through disc 85.

In the position of cylinder 20 as shown in FIG. 7, O-ring 86 tends to move towards disc 81 because of the pressurization of chamber 21*b* and flow passes piston 34. Thus, as shown in FIG. 7 pressurization of chamber 21*b* and inner chamber 29 permits the flow to pass double-acting piston and seal 34 and into chamber 40. As the pressurization of chamber 21*b* and inner chamber 29 increases with relative movement of piston 30, piston 45 of the pressure source begins to move to the right against the compression of spring 51 and the predetermined pressure already present in chamber 42.

Figure 8:
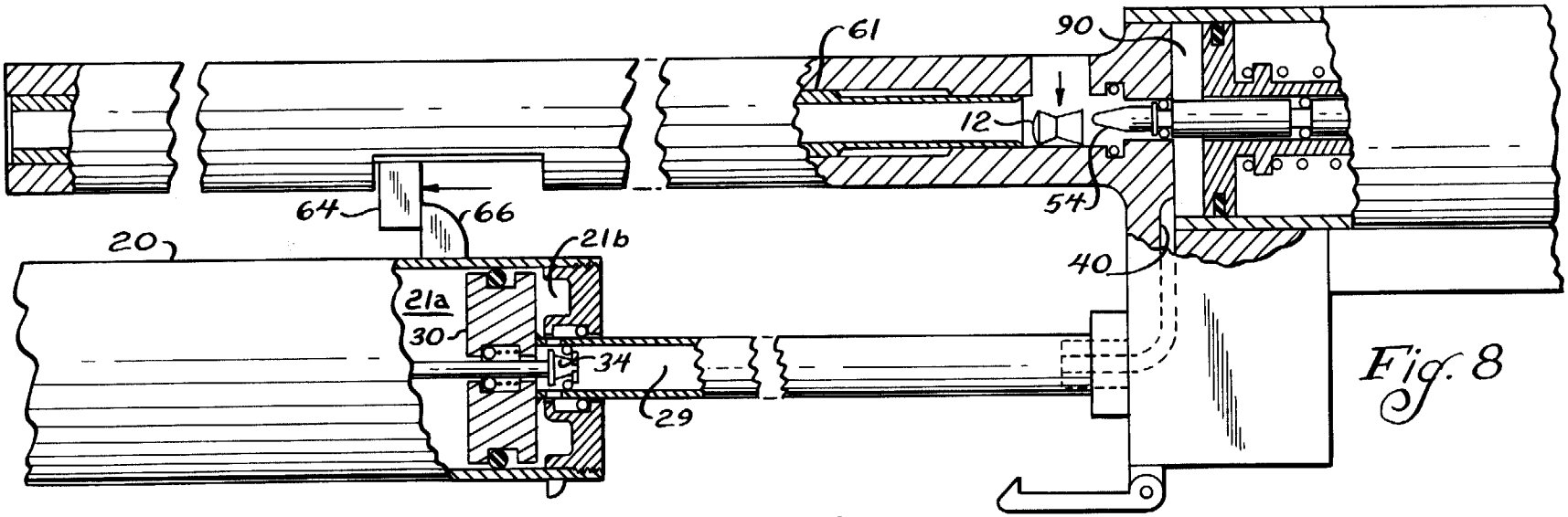
FIG. 8 is a partial schematic side illustration with parts broken away of the pressure or pump actuator at its outermost movement to pressurize the pressure source of the rifle of FIG. 1.

Referring now to FIG. 8 there is illustrated the end of the outward stroke of handle 12 for pressurization of the pressure source 10. At this point piston 30 within the cylinder is immediately adjacent end wall 22 and the atmospheric air within inner cylinder 29, conduit 40 and a projectile actuation chamber 90 in pressure source 10 has reached the end of its first compression cycle of the gas. In one form of the invention it has been found that the pressure within inner chamber 29, conduit 40 and projectile actuation chamber 90 reaches approximately eight times atmosphere pressure. Of course, the exact compression of the air at this stage is dependent on the length of the stroke, the diameter of the cylinders and the volumes of the respective chambers and conduits.

As best illustrated in FIGS. 2, 3 and 8 with cylinder 20 reaching the end of its outward stroke, stop 66 contacts projection 64 of the inner chamber to shift it to the left as shown in FIG. 8 for an extent equal to the width of slot 63 formed in barrel 2. At the end of the stroke, a projectile 12 can fall into the barrel 2 to be positioned immediately adjacent conical projection 54 of rod 44 of pressure source 10.

Figure 9:
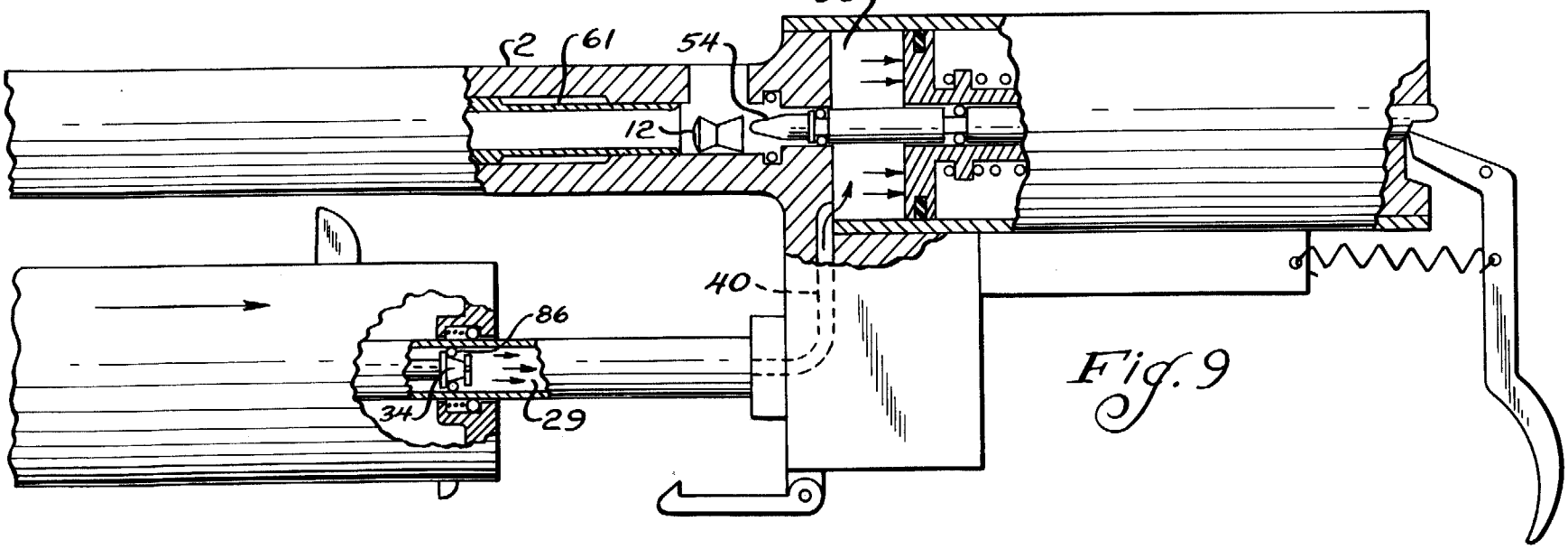
FIG. 9 is a partial schematic illustration with parts broken away of the pressure actuator during a closing stroke to complete charging of the pressure source of the rifle of FIG. 1.

Referring now to FIG. 9 there is illustrated the second pressurization of the gas which occurs during the inward or closing stroke of handle 12. In FIG. 9 the handle has obtained an intermediate position in its movement during which further compression of the air within inner chamber 29, conduit 40 and projectile actuation chamber 90 is achieved. Such compression occurs because piston 34 acts as a piston because seal 86 is pressed against disc 80 due to pressure and movement and no flow passes piston 34. As element 34 moves to the left the volume of chamber 29 is reduced and pressurization occurs to further charge projectile actuation chamber 90 through conduit 40.

During closing reciprocation of handle 12, stop 65 engages projection 34 of inner barrel 61 to shift the inner barrel move back to a position adjacent conical projection 54. As this occurs it should be noted that projectile 12 is designed to be carried by the inner barrel 61 whereby a cavity 91 formed in the back of the projectile is positioned on the conical projection 54 for discharge. The inner chamber 61 during such movement acts to allow a projectile 12 to drop into the barrel during an outward stroke of handle 12 and upon its return carries the projectile into position on conical projection 54 of rod 44. During this action another projectile 12 by suitable means (not shown) can drop into slot 60 to be ready for a succeeding discharge.

Figure 10:
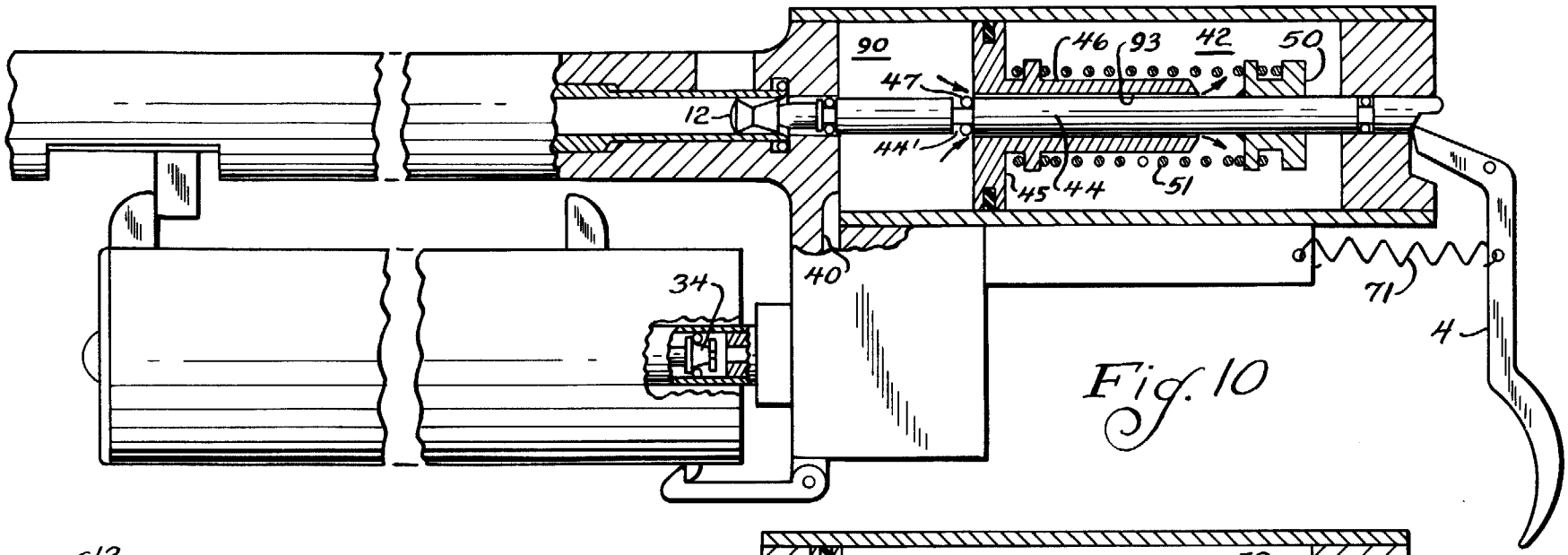
FIG. 10 is a partial schematic illustration of the rifle of FIG. 1 with parts broken away of the pump actuator in its final inward position after a pumping stroke to complete pressurization of the pressure source.

Referring to FIG. 10 there is illustrated the final compression of the pressure introduced into the pressure source 10. At this point piston 34 and cylinder 21 have reached the end of their stroke whereby all the pressure in chamber 29 has been compressed into conduit 40 and projectile actuation chamber 90. At end of the closing stroke of the handle 2 it has been found in one form of the invention that the pressure during the second compression stage can be further increased to as much as three times the pressure of the first compression.

It should be noted that piston 45 has attained a position past seal 44' whereby pressure in chamber 90 can pass through a passage 93 between hub 46 and rod 44 to equalize the pressure as much as possible between chamber 90 and chamber 42. The pressure acting to move piston 45 to the left comprises the pressure in chamber 42 and the amount of compression of spring 51 which equals the pressure in chamber 90. This additional introduction of pressure into chamber 42 by exposure through the movement of seal 44' insures that the piston does not move any farther to the right as viewed in FIG. 10 and that chamber 42 is pressurized for the next operation after release of the pressure in chamber 90 to discharge projectile 12.

Figure 11:
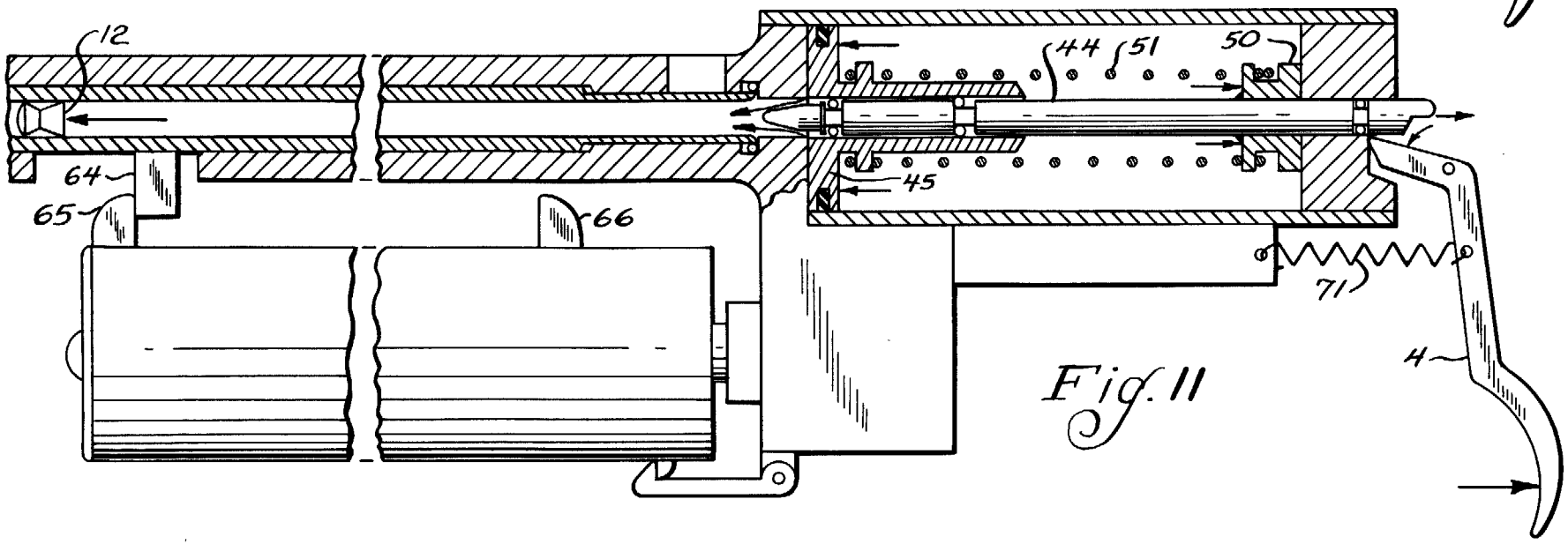
FIG. 11 is a partial schematic illustration with parts broken away of the rifle of FIG. 1 after release of the pressure within the pressure source to discharge the projectile.

Referring now to FIG. 11 the discharge of a projectile after the pressure source 10 has been pressurized is illustrated. As in most rifles, trigger 4 is pulled whereby end 4' moves out of interference with rod 44 and a force built up through the compression of spring 51 urges collar 50 and rod 44 backward or to the right viewing FIG. 11. Such movement moves seal 55 and conical projection 54 out of passage 46 and into projection actuation chamber 90 whereby the pressure in the actuation chamber immediately is discharged against the projectile hurling it to the left and out of barrel 2 for discharge. It should be noted that the volume of the barrel between conical projection 54 and the projectile position as noted in FIG. 11 is equal to the volume of chamber 90 and conduit 40 prior to the trigger being actuated to discharge the projectile. Thus, the projectile is subjected to a constant pressure to the position illustrated because these volumes are equal.

As piston 45 moves to the left in discharging projectile 62, the spring 51 becomes stretched as it moves. After a certain resilient force due to tensioning of the spring is attained, spring 51 tends to pull collar 50 to the left to a final position toward piston 50 after discharge as shown in FIG. 6. This movement of collar 50 to the left under influence of spring 51 compensates for any recoil of the rifle whereby the rifle essentially gives no "kick" and more accuracy of discharge is attained. As the collar 50 moves with rod 44 spring 71 returns trigger 4 back to its position whereby the end of rod 72 is blocked. It is important to note that when piston 45 reaches its final position seal 55 of rod 44 returns to block passage 26'. This event occurs prior to the projectile leaving the end of the barrel so that the net result is that all decompression takes place in the barrel after discharge of a projectile for maximum effect. This function has greatly improved the prior art devices where detrimental decompression changes also occur in the compression chamber resulting in a less effective rifle.

Referring now to FIGS. 12 to 17, there is illustrated another embodiment of the invention for a hand gun based on similar teachings as previously described. One design of the hand gun of the embodiment of FIGS. 12 through 17 is shown in FIG. 12 although the invention may encompass any other suitable design for such devices. In FIG. 12 the pneumatic hand gun in the invention includes a barrel 100, a handle 101, and a body portion 102. The pneumatic pressure source for discharging a projectile is generally supported within the body portion 102 while the pressure actuator is supported in handle 101. The hand gun of FIG. 12 is pressurized by a cocking action which is best shown in FIG. 15 which illustrates a hand gun with handle 101 removed. As illustrated in FIG. 15, barrel 100 is attached to the body portion 102 by means of two pivot arms 104 and 105, respectfully coupled to pressure actuator 101', barrel 100 and body 102. Thus, the hand gun is actuated for discharge of the projectile by cocking or breaking the barrel relative to the body 2 whereby such action carries an outer cylinder 110 mounted within handle 101 relative to an inner cylinder 111 fixedly secured to body 102. The details of these mechanisms will be described in detail later.

Referring now to FIG. 13 there is illustrated pressure actuator 101 and the pressure source **102*b* for discharging a projectile inserted within barrel 100. In FIG. 13 the hand gun is illustrated after pressurization of the pressure source prior to discharge of the projectile. Still referring to FIG. 13, pressure actuator 101' in handle 101 includes an outer cylinder 110 and an inner cylinder 111 whereby outer cylinder 110 is mounted for relative movement to inner cylinder 111 as best shown in FIG. 15. Outer cylinder 110 is closed at an upper end by an end wall 112' and an inner seal supporting element 112. Element 112' supports a spring biased seal 112*a* in a groove in its inner periphery in contact with inner cylinder 111**.

At the lower end of outer cylinder 110 is a ring 113 suitably attached thereto and includes an enlarged opening 114. An end disc 115 supporting flexible seal 116 at its outer periphery lies within opening 114 and maintains opening 114 in a closed position at the operative stage shown in FIG. 13. At the lower end of inner cylinder 111, a piston 120 is fixedly mounted and includes a peripheral surface somewhat spaced from the inner wall of cylinder 110. The piston 120 includes a circumferentially disposed slot 121 supporting therein a seal of a type to be described with reference to FIG. 14 whereby the outer edge of the seal contacts the inner surface of cylinder 110. A passage 123 which may comprise individual passages or a single circumferential space permits fluid communication between circumferential slot 121 and chamber 111' formed by inner cylinder 111.

The inner portion of piston 120 possesses a ringlike element 124 having an internal space to support a spring biased O-ring 125 which can act as a bearing surface permiting relative motion. A longitudinal rod 130 extends the length of chamber 111' and supports at its lower end both piston 120 which can be moved relative to rod 130 and end disc 115 which is mounted in fixed relationship to the rod. At the opposite end of rod 130 there is mounted a double-acting seal and piston 131 which has an additional seal 132 and disc 134 acting to seal the pressure source in the position shown in FIG. 13. Seal 132 contacts a portion of a plug 140 mounted in the end of inner cylinder 111 to abut the body portion 102.

Inner cylinder 111 is affixed by any suitable technique such as welding to a lower base portion 142 integrally formed as part of pressure source cylinder 143. A passage 145 passes through end plug 140, base portion 142 of the cylinder and through an end wall 144 into the chamber 145 created by cylinder 143. A second plug 147 is suitably attached to the opposite end of cylinder 143 and protrudes therethrough beyond the end of the cylinder 143. The plug may be attached to the cylinder by any conventional technique such as by the use of a collar 148 having threads to maintain the plug in sealed position.

A piston 150 interconnected with a collar 150' by means of spring 151 is carried by a longitudinal extending rod 152 through suitable passages formed in end plugs 146 and 147. The operation of the piston 150 and collar 150' along with spring 151 is essentially the same as that described with reference to the foregoing embodiment. It should be understood that the piston 150 is mounted for movement relative to the rod 152 while the collar is in fixed position thereto.

In the embodiment illustrated in FIG. 13 disc **152*a* is formed on the end of rod 152 wherein end plug 146 possesses a passage 146*a* having an enlarged center portion to receive a suitable O-ring 146*b*. The disc end 152*a* of rod 152 is not intended to necessarily come into contact with the projectile prior to discharge. As shown in FIG. 13, the end of the rod 152*a* along with a suitable O-ring provides sealed relationship between the pressure source and the interior of barrel 100.**

Referring to the actuation of rod 152 for discharging a projectile, trigger 103 is connected by a suitable linkage 160 and a pivoted lever 161 to contact an end cutout 162 of rod 152. As trigger 103 is depressed rod 160 and lever 161 move out of interference with the end of the rod 152 to discharge a projectile in the manner indicated in the preceding embodiment of the invention. Projectile 170 when inserted into the pistol is adapted to be maintained at the end of an internal barrel 171 due to its configuration. Internal barrel 171 in this embodiment of the hand gun does not move relative to the barrel 100.

Projectile 170 is inserted when the gun is cocked or opened as shown in FIG. 13 whereby the projectile of suitable design is inserted into the barrel to the position within inner barrel 171 illustrated. Thus, when the barrel is closed to complete the pressurization of the pressure source, the projectile and end of inner barrel 171 are in a position adjacent O-ring seal **146*b* and the projectile is ready for discharge upon depression of trigger 103.**

With respect to pressurization of pressure source **102*b*, final pressurization occurs in conduit 145 and chamber 180 similar as described with reference to the preceding embodiment. The operation of the piston to attain such pressurization is now best understood with reference to description of FIGS. 14 through 17.**

As the pistol is opened as illustrated in FIG. 15, outer cylinder 110 moves downward relative to fixed inner cylinder 111. The initial pressurization of the pressure source **102*b* is best shown in FIG. 16 when cylinder 110 is moving relative to cylinder 111 as the hand gun is being opened or cocked. It should be apparent that as piston 120 moves within outer chamber 110' this action by suction causes atmospheric air to flex seal 116 to conduct atmospheric pressure into chamber 110*a*. After pressurization, the piston returns to the condition of FIG. 13 and chamber 110*a* then again becomes chamber 110'. This atmospheric pressure is what is initially compressed by the downward movement of the cylinder. Thus, piston 120 during downward movement of the cylinder is acting to compress the pressure within chamber 110'** which had been introduced therein in the preceding actuation of the hand gun source.

As cylinder 110 moves downward in FIG. 16, piston 120 acts to compress the air in chamber 110' to be conducted into conduit 145 and projectile actuator chamber 180. The fluid communication between chambers 110' and 111' through seal 122 is best shown in FIG. 14.

Referring now to FIG. 14 the action of seal 190 within piston 120 is best illustrated. The seal 190 is fabricated from a conventional elastomeric material and has a peripheral edge 191 in sealing contact with cylinder 110. Seal 190 further includes two internal projection legs 192 and 193 resiliently biased outward against a surface slot 121 whereby as pressure increases on either side of the piston, one or the other of the legs 192 or 192 can flex as shown in FIG. 14. In FIG. 14 the pressure is increasing on the bottom portion of piston 120 whereby projection 193 flexes to allow pressure to pass into conduit 123 and into inner chamber 111. Thus, referring to FIG. 16, as the pressure increases in chamber 110' due to the movement of the piston 120, the pressure can increase to flex projection 192 and the pressure is introduced into chamber 111'. Afterwards, fluid pressures pass double-acting piston and seal 131 in the same manner as described with reference to FIG. 4 in the preceding embodiment of the rifle.

Referring now to FIG. 17 the closing of the barrel relative to the body and handle is illustrated. As the cylinder 110 moves upward relative to piston 120 the pressure within chamber 111' is compressed by piston 131 until it reaches the position shown in FIG. 13 whereby final pressurization by conduit 145 and chamber 180 has been achieved. Referring now to FIG. 13 the operation of the discharge of the projectile 170 should be apparent. By depressing trigger 103 the rod 152 moves backward exposing the projectile to the pressure in chamber 180 and the projectile is discharged in the manner described with reference to the rifle of FIGS. 1 to 11 with similar improved results.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that this invention not be limited to the particular embodiments disclosed as the best modes contemplated for carrying out this invention, but that the invention will include all embodiments falling within the scope of the appended claims.

What is claimed is:

1. A device for selectively discharging projectiles under the influence of a source of fluid pressure comprising:

chamber means adapted to receive a projectile for discharge therefrom;

a source of discharge fluid pressure operatively coupled to the chamber means and having an initial volume when said chamber means is pressurized;

pressurizing means to selectively create said discharge fluid pressure in the source;

pressurizing control means imposed between said chamber means and said source blocking pressure to a projectile;

actuation means coupled to the pressure control means to selectively permit said source of discharge fluid pressure to contact a projectile for discharge from the chamber means;

said source of discharge fluid pressure includes a source chamber in fluid communication with said pressure control means and said source chamber having pressure equalization means mounted therein; and said pressure equalization means acting to subject a projectile to substantially constant pressure during discharge thereof by maintaining the combined volume of those portions of said source chamber and said chamber means between said pressure equalization means and said projectile substantially equal to said initial volume after pressurization thereof to said discharge fluid pressure until said source of discharge pressure is substantially exhausted of fluid pressurized to said discharge fluid pressure during discharge of said projectile.

2. The device of claim 1, wherein said pressure equalization means includes a piston dividing said source chamber and mounted for longitudinal movement therein.

3. The device of claim 2 wherein said discharge pressure is situated between said piston and said pressure control means within a discharge portion of said chamber means, said piston being movable from a first position after pressurization of said chamber means by said source to a second position after release of a projectile to close said discharge portion; and said movement from said first position to said second position acting to maintain a substantially uniform pressure in said chamber means behind said projectile and in said discharge portion until said piston reaches said second position.

4. The device of claim 2 wherein said piston is subjected to said discharge pressure after being created by said pressurizing means on a side confronting said fluid control means and to a stabilizing force applied to the opposite side of said piston.

5. The device of claim 4 wherein said piston moves to a position in said source chamber after said discharge pressure is created wherein said discharge force equals said stabilizing force.

6. The device of claim 4 wherein stabilizing force is created by a predetermined level of pressure in the source chamber and a resilient force.

7. The device of claim 6 wherein the piston is supported for movement relative thereto by a longitudinal rod extending through the source chamber.

8. The device of claim 7 wherein the rod includes said pressure control means at an end thereof.

9. The device of claim 8 wherein the rod further supports collar means in spaced relation to said piston at a position confronting said opposite side.

10. The device of claim 9 wherein said piston and collar means are operatively interconnected by resilient means creating said resilient force.

11. The device of claim 10 wherein said resilient means is compressed after pressurization of said pressure source.

12. The device of claim 10 wherein said resilient means is under tension after discharge of a projectile.

13. A device for selectively discharging projectiles comprising:

barrel means adapted to receive a projectile for discharge therefrom;

chamber means operatively coupled to the barrel means;

a source of pressure coupled to said chamber means to selectively pressurize said chamber means to a discharge pressure;

actuation means coupled to the barrel means to selectively permit said discharge pressure within said chamber means to contact the projectile for discharge;

said chamber means having movable means mounted for movement toward said barrel means while said source of pressure contacts a projectile;

a compensation member mounted for movement and coupled to said movable means to compensate for recoil occurring during discharge;

said compensation member being coupled to said movable means by resilient means, said resilient means acting to cause movement of said compensation member in the same direction of movement as said movable means in response thereto to apply a force to said chamber means opposite to the force created by discharge of the projectile; and said compensation means applies a force to the chamber means opposite to the force created by discharge of the projectile.

14. The device of claim 13 wherein said movable means comprises a piston.

15. The device of claim 14 wherein said piston resilient means is a spring member.

* * * * *